US005177956A

United States Patent [19]

Shekleton

[11] Patent Number: 5,177,956

[45] Date of Patent: Jan. 12, 1993

[54] ULTRA HIGH ALTITUDE STARTING COMPACT COMBUSTOR

[75] Inventor: Jack R. Shekleton, San Diego, Calif.

[73] Assignee: Sundstrand Corporation, Rockford, Ill.

[21] Appl. No.: 651,549

[22] Filed: Feb. 6, 1991

[51] Int. Cl.[5] ..... F23R 3/34; F23R 3/54; F02C 3/05

[52] U.S. Cl. ..... 60/39.36; 60/746; 60/738

[58] Field of Search ..... 60/39.36, 760, 39.141, 60/39.140, 740, 737, 738, 746, 733

[56] References Cited

U.S. PATENT DOCUMENTS

| | | | |
|---|---|---|---|
| 3,019,605 | 2/1962 | Murray . | |
| 3,099,134 | 7/1930 | Calder et al. | 60/752 |
| 3,134,229 | 5/1964 | Johnson . | |
| 3,713,588 | 1/1973 | Sharpe | 60/742 |
| 3,991,558 | 11/1976 | Schroff | 60/39.141 |
| 4,168,803 | 9/1979 | Simmons et al. | 60/734 |
| 4,205,524 | 6/1980 | Schirmer | 60/732 |
| 4,297,842 | 11/1981 | Gerhold et al. . | |
| 4,301,657 | 11/1981 | Penny . | |

*Primary Examiner*—Richard A. Bertsch
*Assistant Examiner*—Timothy S. Thorpe
*Attorney, Agent, or Firm*—Wood, Phillips, VanSanten, Hoffman & Ertel

[57] ABSTRACT

In order to facilitate operation in a wide variety of operating conditions, and to enhance ultra high altitude starting capability while eliminating start injectors, a radial turbine engine (10) includes a pair of fuel injection zones (24 and 26). The radial turbine engine (10) also includes a turbine wheel (12) coupled to a rotary compressor (14) for axially driven movement, an annular nozzle (16) for directing gases of combustion radially at the turbine wheel (12), and an annular combustor (17). The annular combustor (17) defines an annular combustion space disposed about the turbine wheel (12) and in fluid communication with both the compressor (14) and the nozzle (16), and it receives fuel from a source and air from the compressor (14) which are combusted in the combustion space to generate the gases of combustion. The radial turbine engine (10) is such that the annular combustor (17) is defined by an annular outer wall (18), an annular inner wall (20), and a radial wall (22) extending between the inner and outer walls (20 and 18) axially opposite the nozzle (16). In order to achieve the objectives of the invention, the fuel injection zone(s) (24 and 26) include a plurality of air or oxidant assist fuel atomization injectors (28 and 30) disposed in circumferentially spaced relation, and the injectors (28 and 30) are adapted to inject atomized fuel generally tangentially into the annular combustion space.

18 Claims, 1 Drawing Sheet

ULTRA HIGH ALTITUDE STARTING COMPACT COMBUSTOR

FIELD OF THE INVENTION

The present invention is generally directed to a fuel injection system for a radial turbine engine and, more specifically, a fuel injection system for ultra high altitude starting in compact combustor applications.

BACKGROUND OF THE INVENTION

In small gas turbine engines, it is known that high altitude starting is limited by poor fuel atomization and poor fuel distribution particularly where swirl pressure atomizing fuel injectors are utilized. It has subsequently been found by me that better atomized and distributed fuel, and thus significantly enhanced high altitude starting, can be obtained by the use of pressure impingement fuel injectors which prove to be far more efficient (see my commonly owned and copending patent application Ser. No. 652,010, filed Feb. 7, 1991.) As a further benefit, the complexities, costs and unreliabilities of current start injectors can be eliminated, i.e., ignition can be obtained from a main fuel injector without resort to a start injector.

However, as is well known, altitude starting can be seriously inhibited by reason of chemical kinetics even with good fuel atomization and distribution. Specifically, given a sufficiently high altitude, combustion may not occur because the dome height (and, thus, the combustor volume) is too small. In order to overcome this problem, I have previously disclosed the concept of simulating a relative large volume in a combustor of low dome height by staging fuel injection.

Of course, it is known to be desirable to minimize the number of fuel injectors in small gas turbine engines. In this connection, it is well known that injectors are costly and, where a high number of fuel injectors is required, there will be a resulting low fuel flow per injector which means that the injectors are much more prone to clogging or plug-up. Furthermore, in many instances, small scale viscous effects deteriorate fuel atomization at such reduced fuel flows.

As will be appreciated, when such a condition exists, it is most difficult to achieve a satisfactory level of combustion. This is a particular problem at the low fuel flow rates associated with high altitude starting which might otherwise be overcome if the combustor could be sized sufficiently large to provide additional time for fuel evaporation and combustion therewithin. However, in many instances, it is simply impossible to provide the necessary space for utilization of a combustor of sufficient volume.

As previously mentioned, the desired combustor volume might nevertheless be obtainable for some specific applications. This can be achieved, for instance, by extending the combustor length to account for the limit on dome height. However, it has been determined that this technique does not always successfully result in the desired operating characteristics.

The present invention is directed to overcoming one or more of the foregoing problems and achieving one or more of the resulting objects by further enhancing performance in compact combustors at ultra high altitudes.

SUMMARY OF THE INVENTION

It is a principal object of the present invention to provide a radial turbine engine having improved operating characteristics. It is a further object of the present invention to provide ultra high altitude starting in a compact combustor arrangement. It is yet another object of the present invention to provide air assist fuel atomization injectors in a pair of fuel injection zones within an annular combustor.

Accordingly, the present invention is directed to a radial turbine engine having a turbine wheel coupled to a rotary compressor for axially driven movement thereof, an annular nozzle for directing gases of combustion radially at the turbine wheel, and an annular combustor defining an annular combustion space disposed about the turbine wheel and in fluid communication with both the compressor and the nozzle. The combustor receives fuel from a source and air from the compressor and combusts the fuel and air in the combustion space to generate the gases of combustion. The combustor is defined by an annular outer wall, an annular inner wall and a radial wall extending between the inner and outer walls axially opposite the nozzle. Still additionally, the radial turbine engine includes means for injecting atomized fuel generally tangentially into a pair of fuel injection zones within the combustion space wherein the fuel injecting means associated with at least one of the fuel injection zones comprises at least some air assist fuel atomization injectors disposed in circumferentially spaced relation.

In a preferred embodiment, the radial turbine engine includes a pair of fuel injection zones in axially adjacent relation at a location upstream of the annular nozzle. It is also then advantageous to provide means for controlling distribution of fuel from the source to the respective ones of the fuel injection zones, preferably in the form of valve means for distributing fuel in such a manner that fuel is supplied first to the upstream one of the fuel injection zones. Further, the radial turbine engine preferably includes means for injecting dilution air into a dilution air zone at a point intermediate the fuel injection zones and the nozzle.

In a highly preferred embodiment, the first or upstream fuel injection zone is located at a point adjacent the radial wall and the second or downstream fuel injection zone is located at a point generally intermediate the first fuel injection zone and the nozzle. Still more specifically, the second or downstream fuel injection zone is advantageously axially adjacent the first fuel injection zone and at least the fuel injecting means associated with the first or upstream fuel injection zone, and preferably the fuel injecting means associated with both of the fuel injection zones, comprise air assist fuel atomization injectors. With this arrangement, the fuel injecting means associated with the first and second fuel injection zones, whether or not both comprise air assist fuel atomization injectors, are nevertheless disposed in axially spaced relation along the annular combustor.

Still more specifically, the circumferentially spaced fuel injectors which are associated with each of the fuel injection zones are advantageously disposed in the outer wall of the combustor. It will also be appreciated from the foregoing that the fuel injectors are preferably in axially spaced apart planes which are generally perpendicular to an axis of the combustor. Additionally, the air assist fuel atomization injectors each preferably include a fuel and oxidant supply tube extending generally axially into an air blast tube which extends through the outer wall of the combustor.

Preferably, the radial turbine engine includes a source of oxidant at an elevated pressure in selective communication with the fuel and oxidant supply tubes to direct a blast of oxidant at fuel flowing therethrough.

As for the means for controlling distribution of fuel, it preferably includes first and second fuel manifolds in communication with the fuel and oxidant supply tubes of the air assist fuel atomization injectors associated with the first and second fuel injection zones, respectively. Further, it advantageously includes a control valve upstream of the first and second fuel manifolds. With this arrangement, the control valve can control fuel flow from the source to the first and second fuel manifolds to insure a desired fuel/air mixture to at least the air assist fuel atomization injectors associated with the first fuel injection zone.

Other objects, advantages and features of the present invention will become apparent from a consideration of the following specification taken in conjunction with the accompanying drawings.

DETAILED DESCRIPTION OF THE PREFERRED EMBODIMENT

Figure 1:
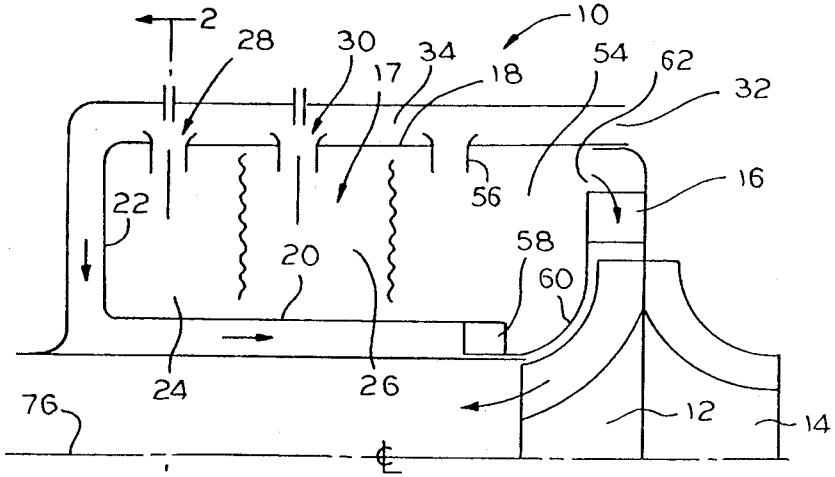
FIG. 1 is a partially schematic cross-sectional view illustrating an ultra high altitude starting compact combustor in accordance with the present invention.

In the illustration given, and with reference first to FIG. 1, the reference numeral 10 designates generally a radial turbine engine in accordance with the present invention which includes a turbine wheel 12 coupled to a rotary compressor 14 for axially driven movement thereof, an annular nozzle 16 for directing gases of combustion radially at the turbine wheel 12, and an annular combustor generally designated 17. The annular combustor 17 defines an annular combustion space disposed about the turbine wheel 12 and in fluid communication with both the compressor 14 and the nozzle 16, and it receives fuel from a source (not shown) and air from the compressor 14 which it combusts in the combustion space to generate the gases of combustion. The annular combustor 17 is defined by an annular outer wall 18, an annular inner wall 20, and a radial wall 22 extending between the outer and inner walls 18 and 20 at a location axially opposite the nozzle 16, i.e., at the end of the combustor 17 axially opposite the nozzle 16. As will be described in detail hereinafter, the radial turbine engine 10 also includes means for injecting atomized fuel generally tangentially into a first or primary fuel injection or flame zone 24 adjacent the radial wall 22 and means for injecting atomized fuel generally tangentially into a second or secondary fuel injection or flame zone 26 intermediate the first fuel injection zone 24 and the nozzle 16.

Figure 2:
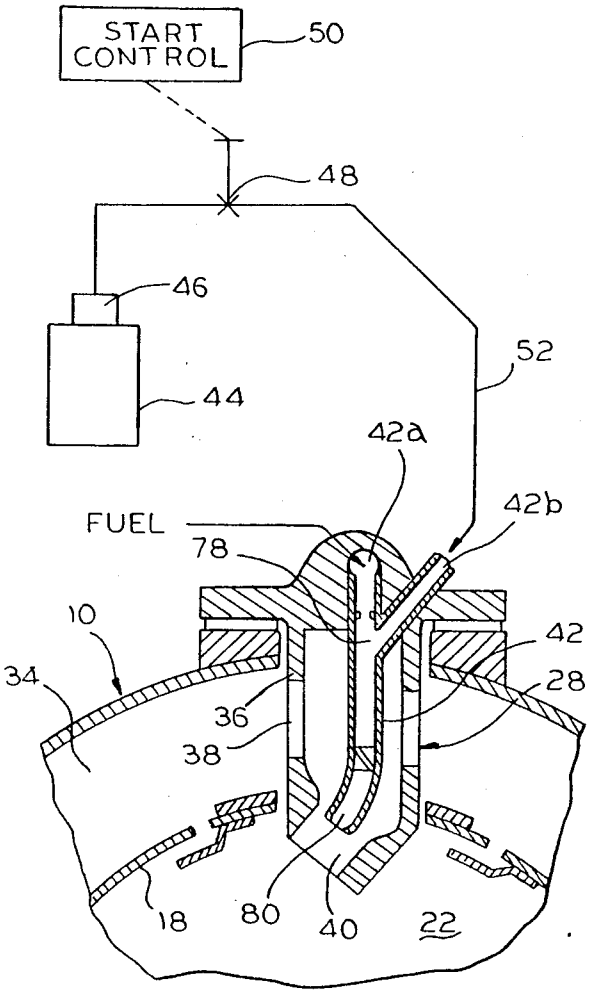
FIG. 2 is a partially schematic cross-sectional view illustrating a fuel injecting system for the ultra high altitude starting compact combustor of FIG. 1.

Still referring to FIG. 1, it will be seen that the second fuel injection zone 26 is axially adjacent the first fuel injection zone 24 at a point upstream of the annular nozzle 16. Also, the fuel injecting means comprises a plurality of circumferentially spaced fuel injectors 28 and 30, respectively, wherein the fuel injectors 28 associated with the first fuel injection zone 24 are axially spaced from the fuel injectors 30 associated with the second fuel injection zone 26. As best shown in FIG. 2, it will be seen and appreciated that at least some of the fuel injectors 28 which are associated with the first fuel injection zone 24 are of the air assist fuel atomization type.

Referring to FIG. 1, the radial turbine engine 10 includes a compressed air inlet 32 leading to an air flow path 34 which extends substantially entirely about the annular combustor 17. It will be seen and appreciated from FIG. 2 that the fuel injectors 28 generally comprise an air blast tube 36 mounted in the outer wall 18 in communication with the air flow path 34. Each of the tubes 36 includes an air inlet 38 and an air/fuel discharge port 40 arranged so as to inject a fuel/air mixture into the annular combustor 17 generally tangentially thereof. As will also be seen, the fuel injectors 28 each include a combined fuel and oxidant supply tube 42 which extends generally axially into the air inlet end 38 of the air blast tube 36.

While the fuel injectors 28 have been shown schematically in FIG. 1, FIG. 2 illustrates one specific form of air assist fuel atomization injector. It will be seen that this specific form of injector, which has been found to achieve the objectives of the invention, has a fuel delivery tube portion **42*a* and an air or oxidant delivery tube portion 42*b* which converge to deliver fuel and air or oxidant, respectively, to the fuel and air or oxidant supply tube 42. As shown, the air or oxidant is delivered from a pressurized oxidant bottle 44** or, alternatively, it can be delivered from an air pump (not shown).

In either case, the radial turbine engine 10 will advantageously have a source of air or oxidant at an elevated pressure. This source of air or oxidant will be in selective communication with the fuel and air or oxidant supply tube 42, e.g., through a pressure regulator 46 connected to the outlet of the bottle 44 which in turn is connected to a flow control valve 48. As will be appreciated, a control system 50 may be employed whenever it is desired to start the radial turbine engine 10.

Still referring to FIG. 2, it will be seen that the control system 50 can be utilized to open or close the flow control valve 48. It should be appreciated in this connection that the control system 50 may be basically conventional. As shown, the outlet side of the valve 48 is connected by means of a conduit 52 to the air or oxidant supply tube portion **42*b***.

Referring once again to FIG. 1, the radial turbine engine 10 may also include means for injecting dilution air into a dilution air zone. The dilution air zone 54, which is at a point intermediate the second fuel injection zone 26 and the nozzle 16, may generally comprise the entirety of the space between the second fuel injection zone 26 and the nozzle 16. Generally speaking, dilution air may suitably be directed generally tangentially into the dilution air zone 54 substantially as shown.

More specifically, the radial turbine engine 10 preferably includes a plurality of circumferentially spaced tangential dilution air tubes 56 in the outer wall 18 of the combustor 17 in communication with the compressed air flow path 34 for injecting dilution air into the dilution air zone 54 generally tangentially thereof. Still additionally, the radial turbine engine 10 preferably includes a dilution air outlet 58 at the end of the compressed air flow path 34 for directing cooling air onto the turbine shroud 60 for cooling the turbine shroud and mixing with the remaining gases at the combustor outlet 62 just upstream of the annular nozzle 16.

Figure 3:
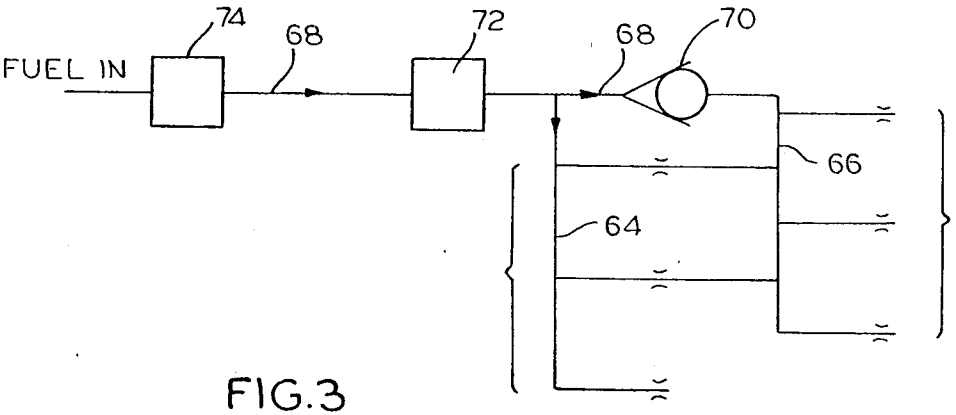
FIG. 3 is a schematic view illustrating a fuel control system for the ultra high altitude starting compact combustor in accordance with the present invention.

Referring now to FIG. 3, the radial turbine engine 10 may advantageously include means for controlling distribution of fuel from the source to the respective ones of the fuel injectors 28 and 30. The controlling means advantageously includes first and second fuel manifolds 64 and 66 associated with the fuel injectors 28 and 30 of the first and second fuel injection zones 24 and 26, respectively, as well as a fuel supply line 68 which interconnects the first and second fuel manifolds 64 and 66 and has therein valve means in the form of a check valve 70 for insuring distribution of fuel from the source first to the fuel injection zone 24 and then, if sufficient fuel flow is available, to the second fuel injection zone 26. As shown, the controlling means also includes an on/off valve 72 and a fuel flow control valve 74 upstream of the first fuel manifold 64 for controlling fuel flow from the source to the first fuel manifold 64 and the check valve 70.

From the foregoing, it should be now be appreciated that the first or primary fuel injection zone 24 comprises a primary flame zone and the second or secondary fuel injection zone 26 comprises a secondary flame zone. The circumferentially spaced fuel injectors 28 and 30 associated with each of the fuel injection zones 24 and 26 (and which may, if desired, all be of the air or oxidant assist fuel atomization type) are disposed in the outer wall 18 of the combustor 17 in axially spaced apart planes generally perpendicular to an axis 76 of the combustor 17, and they are both preferably adapted to direct an air/fuel mixture generally tangentially into the combustor 17 in the same direction. Similarly, the tangential dilution air tubes 56 are adapted to inject dilution air into the dilution air zone 54 generally tangentially in the same direction as the air/fuel mixture.

Although not specifically shown, it will be appreciated that the first and second fuel manifolds 64 and 66 can be in communication with the fuel injectors 28 and 30 in any conventional manner. Thus, where the fuel injectors 28 and 30 are of the air or oxidant assist fuel atomization type such as that illustrated in FIG. 2, the fuel manifolds 64 and 66 will be in communication with the fuel supply tube portions 42*a* of the injectors upstream of the oxidant supply tube portions 42*b* thereof whereby fuel and oxidant may meet at the junctures 78 where the tube portions 42*a* and 42*b* converge into the fuel and oxidant supply tubes 42. In this manner, a blast of air or oxidant may be directed into the fuel upstream of the discharge ends 80 of the fuel and oxidant supply tubes 42 and upstream of the air/fuel discharge ends 40 of the fuel injectors.

For purposes of better understanding the nature and operation of the air or oxidant assist fuel atomization injectors such as 28 illustrated in FIG. 2, the teachings of commonly owned and copending patent application Ser. No. 455,605, filed Dec. 21, 1989 are hereby expressly incorporated herein by reference.

From the foregoing, it should now be appreciated that it is possible to atomize fuel in a combustor under very adverse conditions. This can be accomplished essentially without regard to extremely low fuel flow rates or the utilization of viscous fuels by using air or oxidant assist during starts as from an air pump or pressurized oxidant bottle or the like. In this manner, it is possible to completely eliminate the problems which have been associated with fuel atomization at high altitudes.

More specifically, by air atomizing fuel and distributing it generally tangentially in two fuel injection zones, it is possible to avoid poor fuel atomization which is a particularly critical problem for high altitude starting applications. With the present invention, it is possible to substantially increase altitude ignition capability despite very low fuel flows since it is possible to provide optimal, stoichiometric air/fuel ratios.

While in the foregoing there has been set forth a preferred embodiment of the invention, it will be appreciated that the details herein given may be varied by those skilled in the art without departing from the true spirit and scope of the appended claims.

I claim:

1. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said turbine wheel and in fluid communication with both said compressor and said nozzle, said combustor receiving fuel from a source and air from said compressor and combusting fuel and air in said combustion space to generate said gases of combustion, said annular combustor being defined by an annular outer wall, an annular inner wall, and a radial wall extending between said inner and outer walls axially opposite said nozzle; and means for simultaneously injecting atomized fuel generally tangentially into a pair of fuel injection zones within said combustion space, said fuel injecting means associated with at least one of said fuel injection zones comprising at least some air assist fuel atomization injectors, said air assist fuel atomization injectors being disposed in generally circumferentially spaced relation.

2. The radial turbine engine of claim 1 wherein said pair of fuel injection zones are in axially adjacent relation at a location upstream of said annular nozzle.

3. The radial turbine engine of claim 2 including means for controlling distribution of fuel from said source to the respective ones of said fuel injection zones.

4. The radial turbine engine of claim 3 wherein said controlling means includes valve means for distributing fuel first to an upstream one of said fuel injection zones.

5. The radial turbine engine of claim 1 including means for injecting dilution air into a dilution air zone at a point intermediate said fuel injection zones and said nozzle.

6. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said turbine wheel and in fluid communication with both said compressor and said nozzle, said combustor receiving fuel from a source and air from said compressor and combusting fuel and air in said combustion space to generate said gases of combustion, said annular combustor being defined by an annular outer wall, an annular inner wall, and a radial wall extending between said inner and outer walls axially opposite said nozzle;

means for simultaneously injecting fuel generally tangentially into a first fuel injection zone located at a point adjacent said radial wall and into a second fuel injection zone located at a point generally intermediate said first fuel injection zone and said nozzle, said second fuel injection zone being axially adjacent said first fuel injection zone and said fuel injecting means associated with at least said first fuel injection zone comprising a plurality of circumferentially spaced air assist fuel atomization injectors; and means for controlling distribution of fuel from said source to the respective ones of said fuel injection zones.

7. The radial turbine engine of claim 6 wherein said fuel injecting means associated with said first and second fuel injection zones are axially spaced.

8. The radial turbine engine of claim 7 wherein said fuel injecting means associated with both of said fuel injection zones include air assist fuel atomization injectors.

9. The radial turbine engine of claim 6 wherein said controlling means includes valve means for distributing fuel first to said first fuel injection zone.

10. The radial turbine engine of claim 6 including means for injecting dilution air into a dilution air zone at a point intermediate said second fuel injection zone and said nozzle.

11. The radial turbine engine of claim 6 wherein said air assist fuel atomization injectors each include a combined fuel and oxidant supply tube extending generally axially into an air blast tube extending through said outer wall of said combustor.

12. The radial turbine engine of claim 11 including a source of oxidant at an elevated pressure in selective communication with said fuel and oxidant supply tubes to direct a blast of oxidant to fuel flowing therethrough.

13. A radial turbine engine, comprising:

a turbine wheel coupled to a rotary compressor for axially driven movement thereof;

an annular nozzle for directing gases of combustion radially at said turbine wheel;

an annular combustor defining an annular combustion space disposed about said turbine wheel and in fluid communication with both said compressor and said nozzle, said combustor receiving fuel from a source and air from said compressor and combusting fuel and air in said combustion space to generate said gases of combustion, said annular combustor being defined by an annular outer wall, an annular inner wall, and a radial wall extending between said inner and outer walls axially opposite said nozzle;

means for simultaneously injecting fuel tangentially into a first fuel injection zone adjacent said radial wall and into a second fuel injection zone generally intermediate said first fuel injection zone and said nozzle, said second fuel injection zone being axially adjacent said first fuel injection zone and said fuel injecting means comprising a plurality of circumferentially spaced fuel injectors associated with each of said fuel injection zones wherein at least said fuel injectors associated with said first fuel injection zone are of the air assist fuel injection type, said circumferentially spaced fuel injectors associated with each of said fuel injection zones being disposed in said outer wall of said combustor in axially spaced apart planes generally perpendicular to an axis of said combustor;

means for controlling distribution of fuel from said source to the respective ones of said fuel injection zones; and means for injecting dilution air into a dilution air zone intermediate said second fuel injection zone and said nozzle.

14. The radial turbine engine of claim 13 wherein said controlling means includes valve means for distributing fuel first to said first fuel injection zone.

15. The radial turbine engine of claim 14 wherein said air assist fuel atomization injectors each include a combined fuel and oxidant supply tube extending generally axially into an air blast tube extending through said outer wall of said combustor.

16. The radial turbine engine of claim 13 wherein said controlling means includes first and second fuel manifolds in communication with said fuel and oxidant supply tubes of said air assist fuel atomization injectors associated with said first and second fuel injection zones, respectively.

17. The radial turbine engine of claim 16 including a source of oxidant at an elevated pressure in selective communication with said fuel and oxidant supply tubes to direct a blast of oxidant to fuel flowing therethrough.

18. The radial turbine engine of claim 16 wherein said controlling means includes a control valve upstream of said first and second fuel manifolds for controlling fuel flow from said source to said first and second fuel manifolds to ensure a desired fuel/air mixture to at least said air assist fuel atomization injectors associated with said first fuel injection zone.

* * * * *